US009476222B1

(12) United States Patent
Johnson

(10) Patent No.: US 9,476,222 B1
(45) Date of Patent: Oct. 25, 2016

(54) LATCH BLOCKER SAFETY STRIKE PLATE

(71) Applicant: Brian A. Johnson, Saint Joseph, MN (US)

(72) Inventor: Brian A. Johnson, Saint Joseph, MN (US)

( * ) Notice: Subject to any disclaimer, the term of this patent is extended or adjusted under 35 U.S.C. 154(b) by 134 days.

(21) Appl. No.: 14/468,432

(22) Filed: Aug. 26, 2014

Related U.S. Application Data

(60) Provisional application No. 61/871,385, filed on Aug. 29, 2013.

(51) Int. Cl.
*E05B 15/02* (2006.01)

(52) U.S. Cl.
CPC ..... *E05B 15/0205* (2013.01)

(58) Field of Classification Search
CPC ..... Y10T 292/694; Y10T 16/61; Y10T 292/394; Y10T 292/79; E05B 17/005; Y10S 292/11; E05Y 2201/224
USPC ..... 292/341.14
See application file for complete search history.

(56) References Cited

U.S. PATENT DOCUMENTS

| | | | | |
|---|---|---|---|---|
| 987,271 | A | 3/1911 | Upton | |
| 1,005,906 | A * | 10/1911 | Varner | E05B 15/0205 292/189 |
| 2,249,294 | A | 7/1941 | Kohler | |
| 2,520,195 | A * | 8/1950 | Bienek | E05B 15/0205 292/341.14 |
| 2,630,005 | A | 3/1953 | Raivetz | |
| 2,726,892 | A | 12/1955 | Zynda et al. | |
| 3,309,126 | A | 3/1967 | Schuette | |
| 3,458,227 | A | 7/1969 | Bryson et al. | |
| 4,159,838 | A | 7/1979 | Wilzig et al. | |
| 5,004,279 | A | 4/1991 | Radcliff | |
| 5,074,604 | A | 12/1991 | Merendino et al. | |
| 6,082,790 | A | 7/2000 | Mossotti et al. | |
| 6,698,807 | B1 | 3/2004 | Wacker | |
| 7,766,400 | B2 | 8/2010 | Predebon | |
| 8,177,267 | B2 | 5/2012 | Kuehn | |

FOREIGN PATENT DOCUMENTS

| | | | |
|---|---|---|---|
| AU | WO 03/014502 | A1 * | 2/2003 |
| CH | 212832 | B | 4/1941 |
| WO | WO 84/00394 | A1 | 2/1984 |
| WO | WO 00/03108 | A1 | 1/2000 |

* cited by examiner

*Primary Examiner* — Mark Williams
(74) *Attorney, Agent, or Firm* — Albert W. Watkins

(57) ABSTRACT

A door latch blocker safety strike plate has a strike plate, a latch blocker, and a hinge pivotally coupling the latch blocker to the strike plate. The strike plate has a generally planar plate and a curved section. The generally planar plate has spaced apart mounting holes, and a keeper hole adapted to operatively align with a keeper opening in a door jamb. The keeper hole is interposed between mounting holes. The latch blocker also has a generally planar plate and a curved section. The latch blocker pivots about the hinge through approximately 270 degrees to selectively cover the keeper, and thereby block the door bolt, or pivot away from and expose the keeper, to allow the door bolt to engage first with the strike plate and subsequently with the keeper.

20 Claims, 4 Drawing Sheets

LATCH BLOCKER SAFETY STRIKE PLATE

CROSS REFERENCE TO RELATED APPLICATIONS

This application claims the benefit under 35 USC 119(e) of U.S. provisional patent application 61/871,385 filed Aug. 29, 2013 and herewith, the contents and teachings which are incorporated herewith by reference.

BACKGROUND OF THE INVENTION

1. Field of the Invention

This invention pertains generally to closure fasteners, and more particularly to keepers in which a bolt or latch receiving socket is provided with a movable cover. A preferred manifestation of the invention is a door latch blocker coupled by a hinge to a strike plate. The latch blocker pivots about the hinge to selectively cover the keeper, and thereby block the door bolt, or pivot away from and expose the keeper, to allow the door bolt to engage with the keeper. In one manifestation, the assembly is reversible to replace standard strike plates and accommodate left and right-handed doors that open in or out.

2. Description of the Related Art

Buildings and other similar static structures have openings, sometimes referred to as portals, that provide access to and from interior spaces within the building. These portals are ordinarily controlled by a moving door or window that can be opened or closed. Doors may be found in the exterior walls of the building, in which case they may be sealed against the elements when closed, and may also typically be secured to allow the building to be locked when desired. Similarly, interior doors control portals in the building interior, for exemplary and non-limiting purposes only such as between a room and a hallway. These interior doors are not usually exposed to the elements, but may in many cases be provided with some type of lock allowing the individual room to be secured, even when access to the hallways is still being provided through the exterior doors.

Many doors designed primarily for use by people consist of a panel that swings on hinges. These doors typically have one or several hinges mounted on one vertical edge of the door panel that are anchored to the door jamb. On the other vertical edge of the door panel a retractable bolt may protrude. The retractable bolt is selectively inserted into an opening in the door jamb referred to as a keeper. When the retractable bolt extends into the keeper, the door is latched closed. When the retractable bolt is retracted from the keeper, the door is free to swing open. Most doors are prevented from swinging from one side of the frame on through the door jamb and out the other side by a thin slat built inside the door frame, commonly referred to as a doorstop. There is a strike plate provided with a gentle slope, such that when the door is pivoting towards the doorstop with spring-loaded bolt protruding from the door edge, the bolt will engage with the strike plate and gradually be retracted into the door as the door continues to swing shut. Eventually as the door continues to rotate closed, the door will swing into engagement with the doorstop, and at this position the spring-loaded bolt will push into the opening defined by the keeper. With the bolt engaged in the keeper, the door is held shut.

Doors can serve many functions, among them the control of passage of people and animals through the portal. This means the door can be used to selectively keep people either in or out of a building space. The door can also act as a barrier to movement of air, which can be critical in heating, ventilation and air conditioning (HVAC); in limiting noise transmission; and in limiting the spread of a fire. For many applications, it is desirable to enable and preserve each of these uses, to maintain full functionality of the door. This is particularly true in public buildings, where control in any other way can be extremely difficult.

Unfortunately, in public buildings, a person within a room or other space will often not have a key or other way to control the door. For exemplary purposes only, and not limiting the invention solely thereto, a school may have many students in a classroom. Ordinarily, a teacher will be present, but the teacher may also be the only person in the room to whom a key has been provided. In such instance, the primary purpose of the key is to enable the teacher to secure the classroom at the end of the school day against passage of people, thereby preventing after-hours theft or vandalism. Often times, the school building may be open long after the final class has been dismissed, such as for various extra-curricular activities including but not limited to band concerts, sporting events, and even parent-teacher conferences. To preserve the classrooms, it is desirable to lock the classroom doors at the end of the classroom day, thereby preventing intruders or vandals, while still keeping other facilities within the school open much longer.

The classroom door will also typically, but not always, be closed during classroom instruction to limit noise transmission, so that any activities taking place in the hallways are less likely to disrupt the classroom or distract the students. Between periods of classroom instruction, the door may then be opened up to allow the students to pass through and on to their next assigned classroom.

In the event of a fire, gas leak, hazardous chemical release, or other similar emergency, a door may also be used to contain the fire or gas to a particular room or building space. In many of these cases, the building occupants will be escorted through the building halls, preferably away from the quarantined area, and out of the building to a safe location. However, if safe passage out of the building is not immediately possible, the door will also preferably provide a barrier to the movement of the fire or noxious gases into the classroom, allowing the occupants greater time within which to be rescued.

While historically fire was one of the greatest hazards to building occupants, more recently many public buildings have been constructed of concrete, steel and other similar fire resistant materials. While fire has not and likely never will be completely eliminated as a hazard, a new hazard has arisen that has drawn much media attention.

Public spaces naturally have a high concentration of people during ordinary hours of operation. Exemplary public spaces include, but are not solely limited to schools, governmental buildings, apartment buildings, and many office buildings. Communities depend upon these public spaces being safe. Unfortunately, with the concentrations of people, an intruder who wishes to bring harm in such spaces can present a very real and substantial hazard to many people.

One way to slow or block the intruder from accessing the people in a community space is by using a door to also control or limit the access that such an intruder may have into these spaces. This can be quite beneficial for security, since a person intruding upon a space can be stopped or slowed by a secured door. However, as noted above, in community spaces there are usually only a few people who may have keys to lock the doors.

Protecting a space from an intruder is quite different from preventing vandalism or theft. In the case of an intruder, there will often be very little time to secure the door. Most preferably, the closest person to the door will secure the door. With many lives at stake, the excitement of the moment will in and of itself present enormous challenge. Consequently, the mechanism will preferably be as simple as possible and activated by whomever is closest, regardless of their skills or training.

There may also be circumstances where it may be desirable to provide an occupant a keyless method for quickly, selectively allowing people access through the doorway. In the case of the public spaces, once the space has been unlocked by a person with keys, people will normally move freely through the building. In another instance, when a person wishes to step out of their apartment or hotel room, perhaps to flag down a service or delivery person, they may not always remember or have ready access to the room key. Another instance might be where a number of guests will be arriving, none whom would otherwise be able to pass through an automatically locking door. Consequently, it is desirable to provide rapid and intuitive enablement to both secure a door and to alternatively release a door lock.

A number of skilled artisans have developed methods for selectively controlling a door lock. Some exemplary patents, the teachings and contents which are incorporated herein by reference, include U.S. Pat. No. 5,074,604 by Merendino et al, entitled "Door knob and latch retaining device"; and U.S. Pat. No. 8,177,267 by Kuehn, entitled "Door anti-latch device". The Merendino et al patent uses a traditional round rotary interior house door knob, and provides a member that frictionally engages between the rotary knob and the door, to cause the knob, and therefore the bolt, to stick in whatever position a person sets the knob to. This device may have utility with many interior house doors, but unfortunately the amount of friction will vary both between different doors and with the age of the door. Furthermore, not all door knobs are round, particularly in public buildings. The Kuehn patent discloses a device that blocks the door from closing completely, thereby preventing the bolt from ever aligning with the keeper. While this and similar door blocking devices can be very effective, the force of the door swinging shut can damage the blocking device or the door frame. Furthermore, many of the benefits that would be obtained from a closed door, such as the blocking of noises outside of a classroom for example, are lost.

Another set of artisans have devised apparatus that are attached to a door component to block the door bolt from entering into the keeper, and are then removed to inactivate bolt block. Exemplary patents, the teachings and contents which are incorporated herein by reference, include patents: U.S. Pat. No. 2,249,294 by Kohler, entitled "Device for preventing the unintentional shutting of doors"; U.S. Pat. No. 2,726,892 by Zynda et al, entitled "Safety lock clip"; U.S. Pat. No. 3,309,126 by Schuette, entitled "Child-safe door catch assembly"; U.S. Pat. No. 5,004,279 by Radcliff, entitled "Door latch holder"; U.S. Pat. No. 6,698,807 by Wacker, entitled "Latch guard"; U.S. Pat. No. 7,766,400 by Predebon, entitled "Door stay"; CH 212,832 by Kohler, entitled "Device on a door to prevent accidental slamming of the same"; and WO 8400394 by Busch, entitled "Element for preventing the closing of a door". One of the challenges with these apparatus is how to keep or store the bolt blocking apparatus when it is not in use, and yet to ensure that the apparatus is available when needed. The Busch international patent application provides a separate plate to which the magnet may stick when the magnetic apparatus is not in place blocking the lock. Nevertheless, many of these apparatus will be easily fumbled or dropped in an emergency situation by a person of ordinary nerves. Furthermore, in a commercial or other public location even those few patents such as the Radcliff and Predebon that provide a pair of hangers from opposed knobs, these apparatus will be lost, stolen, or vandalized in short order, rendering the facility unprotected against intruders.

Another much more limited group of patents illustrate or may be adapted in light of the teachings of the present invention to be always available, selectively applied bolt blocks. Exemplary patents, the teachings and contents which are incorporated herein by reference, include patents: U.S. Pat. No. 6,082,790 by Mossotti et al, entitled "Door anti-locking device"; U.S. Pat. No. 987,271 by Upton, entitled "Attachment for door latches"; U.S. Pat. No. 2,630,005 by Raivetz, entitled "Lock bolt retainer"; U.S. Pat. No. 3,458,227 by Bryson et al, entitled "Closure Device"; U.S. Pat. No. 4,159,838 by Wilzig et al, entitled "Door latch bolt locking device"; and WO 0003108 by Micudaj, entitled "Safety device for locking elements on doors or similar". The Mossotti et al door anti-locking device provides many desirable features, such as easy installation onto an existing strike plate, rapid actuation, and ensured presence when needed.

Unfortunately, even the Mossotti et al patent suffers from several undesirable limitations. The primary limitation is the need for precise control over the torque used to tighten the hardware that holds both the anti-locking device and the strike plate together in place in the door frame. If the screw is tightened down too much, the plate will not be free to rotate. If instead the screw is too loose, then the plate will not stay in the upright, out-of-the-way position illustrated on the front page of the patent. Furthermore, the Mossotti et al device relies upon a vertical position for the inactive state or door-locked position, a position which is not easily set or maintained. In other words, in the event of an intruder, a person may in haste swing the Mossotti et al anti-locking device hard enough for the device to bounce off of the doorstop, in which case the anti-locking device will simply pivot back down to the one stable position, which is blocking the keeper and keeping the door open. Consequently, the Mossotti et al device requires periodic maintenance to ensure that the anchoring screw is properly tightened and functioning, and, in an emergency situation, requires a person of more calm than most can be expected to have to carefully rotate and hold the device in the upright position out of the way of the keeper before closing the door.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a door having a latching door lock, and a door jamb having a strike plate and keeper operative with the latching door lock to lock a door. The strike plate has a generally planar surface with at least one hole therein through which the latching door lock will engage to lock the door; and a curve along an edge of the generally planar surface that is distal to the at least one hole and is adjacent to an edge of the door jamb. The improvement comprises a hinge adjacent to and affixed with an edge of the curve distal to the generally planar surface. A latch blocker has a generally planar plate and a curve along an edge of the latch blocker generally planar plate. The latch blocker is pivotally coupled through the hinge and pivotal thereabout to a first end position of travel placing the latch blocker generally planar plate immediately adjacent to the strike plate and thereby covering the strike plate and keeper, and placing the latch blocker curve immediately adjacent to the strike plate curve. The latch blocker is also pivotal to a second position of travel distal to the first end position of travel, in this position uncovering the strike plate and keeper and thereby adapted to operatively enable the latching door lock to engage the strike plate and keeper.

In a second manifestation, the invention is a latch blocker safety strike plate. A strike plate has a generally planar plate and a curved section. The generally planar plate has a keeper hole there through adapted to operatively align with a keeper opening in a door jamb. A latch blocker has a generally planar plate and a curved section. A hinge pivotally couples the latch blocker to the strike plate. The latch blocker plate is pivotal about the hinge to a first farthest position of rotation in a first direction about the hinge laying parallel and immediately adjacent to the strike plate generally planar plate. In this first farthest position of rotation, the latch blocker plate blocks the keeper hole. The latch blocker plate is also pivotal to a second position of rotation in a second direction about the hinge that is opposed to the first direction of rotation. In this second position, the latch blocker plate is displaced from the strike plate generally planar plate and thereby exposes the keeper hole.

OBJECTS OF THE INVENTION

Exemplary embodiments of the present invention solve inadequacies of the prior art by providing a door latch blocker coupled by a generally vertical axis hinge to a strike plate. The latch blocker pivots about the hinge to selectively cover the keeper, and thereby block the door bolt, or pivot away from and expose the keeper, to allow the door bolt to engage first with the strike plate and subsequently with the keeper.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to selectively control the passage of people through a doorway, and more specifically to slow or block an intruder from accessing people in a community space by using a door to control or limit the access that an intruder may have into these spaces. A second object of the invention is to provide an apparatus that will fit nearly every door through a direct and low cost door strike plate replacement. As a corollary to this second object, the apparatus will preferably be easy and rapid to install using common tools, such as with screwdriver or drill. Another object of the present invention is a consistent activation force, independent of ordinary manufacturing or installation events. A further object of the invention is for the apparatus to be essentially maintenance-free, durable and dependable, preferably capable of being exposed to the elements for use with either exterior or interior doors and further having ensured presence, so that the apparatus cannot be lost or misplaced. Yet another object of the present invention is to provide keyless operation that is simple to activate and de-activate, with stable positions in either active or inactive states. This ensures that the mechanism will be rapidly activated by whomever is closest, regardless of their skills or training. An additional object of the invention is to provide an apparatus that can be used while still enabling the key to secure the door against passage of people. A further object of the invention is to provide an apparatus that can be used repeatedly, without harm to the door or the door frame. An even further object is for the apparatus of the present invention to allow the door to completely close when in use, and thereby allow the door to also act as a barrier to movement of air, which can be critical in heating, ventilation and air conditioning (HVAC); in limiting noise transmission; and in limiting the spread of a fire, gas leak, noxious gases, hazardous chemical release, or other similar emergency.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
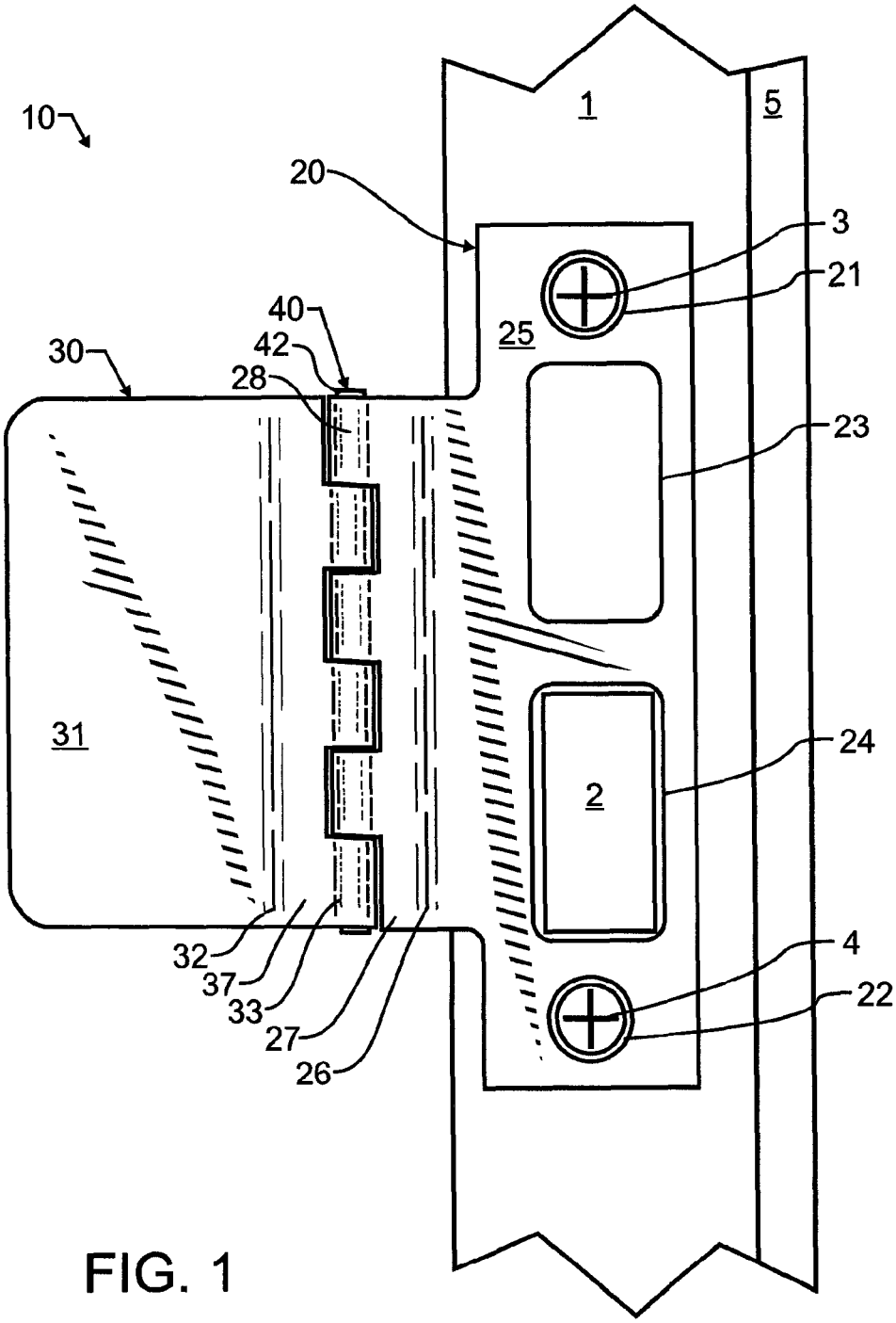
FIG. 1 illustrates a preferred embodiment latch blocker safety strike plate designed in accord with the teachings of the present invention from a front elevational view in an open, unblocked position and mounted in a door jamb adjacent to the keeper.

In a preferred embodiment of the invention illustrated in FIGS. 1-5, a latch blocker safety strike plate 10 has a strike plate 20 coupled through hinge 40 to latch blocker 30. Preferred embodiment latch blocker safety strike plate 10 is preferably a direct replacement for a pre-existing prior art strike plate that is affixed to a door jamb 1 adjacent to a keeper 2 using fasteners 3, 4.

Strike plate 20 has a generally rectangular metal plate 25 connected to a hinge 40 by a short curved section of metal 26 and another generally rectangular metal plate 27. Strike plate 20 may for exemplary purposes and not solely limiting the invention thereto, have two circular holes 21, 22 and two rectangular holes 23, 24 as illustrated in the preferred embodiment.

On the other side of the hinge 40, latch blocker 30 has a rectangular metal plate 37, a short curved section of metal 32 and a shorter rectangular metal plate 31. Latch blocker 30 may for exemplary purposes and not solely limiting the invention thereto, have no perforations.

A latch blocker safety strike plate 10 designed in accord with the teachings of the present invention can be used to prevent a door from latching and possibly locking, if the handle is set to lock automatically. This can be used beneficially in many situations, including but not limited to situations where the sound of the door opening and closing may be distracting, in situations where it may be physically challenging for one to use a door handle to unlatch a door and open it, in situations where a user does not have a key, or in situations where the key is available but not readily accessible.

Most preferably, a latch blocker safety strike plate 10 designed in accord with the teachings of the present invention is used in combination with a door that is set to automatically lock upon latching when closed, to normally prevent the door from latching and thereby prevent the door from locking. However, in an emergency situation or in other desired circumstance, latch blocker 30 may be pivoted, thereby allowing the door to latch and lock when closed. This might, for exemplary purposes, be desired during a school invasion, where it is highly desirable to quickly lock individual doors to thereby slow or inhibit a perpetrator from moving about the school and into individual classrooms. In such an emergency, any person near the door can quickly lock the door simply by pivoting the latch blocker 30 from the position illustrated in FIGS. 3-5, which illustrate the latch holes blocked by the latch blocker 30, to the position illustrated in FIGS. 1 and 2, which illustrate the latch holes being open for a door to latch through.

Figure 2:
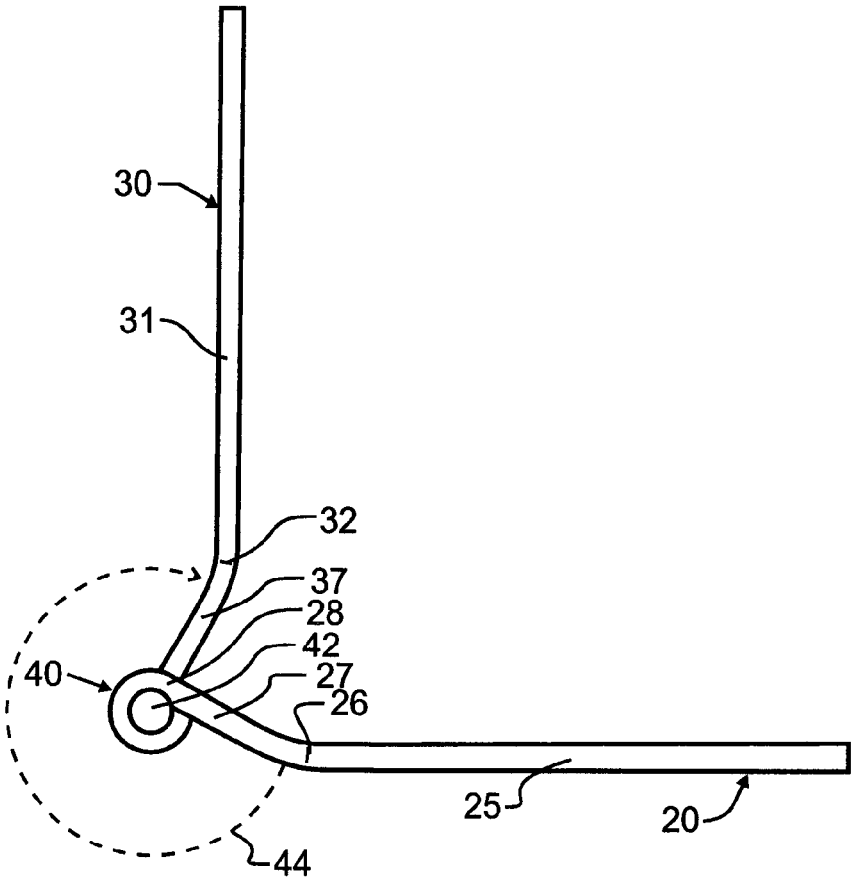
FIG. 2 illustrates the preferred embodiment latch blocker safety strike plate of FIG. 1 from a top perspective view in an open, unblocked position.

In preferred embodiment latch blocker safety strike plate 10 this pivotal motion is about an axis defined by the longitudinal axis of hinge pin 42 in hinge 40. The arc of motion through which latch blocker 30 will travel, approximately 270 degrees in the preferred embodiment, is illustrated in FIG. 2 by dashed line 44. Because the axis of rotation is a generally vertical axis, latch blocker 30 may manually be flipped quickly and easily, with reduced chance of latch blocker 30 bouncing back into the blocking position when compared to the Mossotti et al patent incorporated herein above by reference. In other words, in preferred embodiment latch blocker safety strike plate 10, latch blocker 30 is stable in any orientation about hinge pin 42, and not biased by gravity towards one orientation or the other. This can be critical in an emergency, where a stressed individual is trying to rapidly lock the door.

Figure 5:
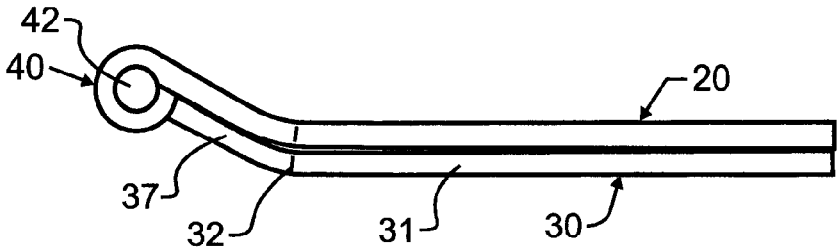
FIG. 5 illustrates the preferred embodiment latch blocker safety strike plate of FIG. 1 from a top perspective view in a closed, blocked position.

In a further contemplated alternative embodiment, hinge pin 42 may be tilted from vertical, with the top of hinge pin 42 closer to hole 21 than the bottom of hinge pin 42, and with the top of hinge pin 42 displaced further behind the plane surface of plate 25 than the bottom. This will create a slight tilt in latch blocker 30, which will cause latch blocker 30 to have a slight gravitational bias towards being either entirely closed and blocking keeper 2, at the first end position of rotation about hinge pin 42 as shown in FIG. 5, or being rotated through a full 270 degrees therefrom to the second extreme position illustrated in FIG. 2. Other techniques are contemplated herein, such as forming slopes within the opposed looped portions 28, 33 that can also be used to provide a slight bias. These slopes are known in the art of doors, and for exemplary and non-limiting purpose have been more recently used in refrigerators to help to keep the door closed or fully open. Nevertheless, these special hinge constructions will add expense that may not be appropriate for all applications and so may not be preferred.

In a further alternative embodiment, the co-efficient of friction within hinge 40 may be controlled through techniques such as the provision of polymer sleeves, special surface finishes or texturing, or other technique to provide a particular coefficient of friction which may be low for easy movement, or high to prevent any bouncing at the end of travel, or at any desired intermediate level.

Strike plate 20 is preferably secured to door jamb 1 by two screws 3, 4 that are inserted through the mounting holes 21, 22 shown in FIG. 1, with hinge 40 protruding past door jamb 1, away from the door jamb stop. Strike plate 20 is preferably installed at the proper height and location so that at least one of the latch holes 23, 24 line up with keeper 2 when the door is closed, just as an ordinary prior art strike plate would be located. In fact, most preferably the strike plate 20 of the present invention will act as a direct replacement for an existing prior art strike plate, and so may be designed in different models and geometries to accommodate different door strike plate designs. While the preferred embodiment is illustrated as having two vertically displaced latch holes 23, 24, alternative embodiment latch blocker safety strike plates may have a different latch hole configuration, such as a single hole, a different hole size, a different hole position, or a different hole shape to accommodate various different door models. Two holes illustrated in the preferred embodiment permit strike plate 20 to be rotated top to bottom at the time of installation, allowing the same plate to be used in some cases on either a right-handed or a left-handed commercial door. Noteworthy here is that preferred embodiment latch blocker safety strike plate 10 will fit nearly every door through a direct and low cost door strike plate replacement. Furthermore, preferred embodiment latch blocker safety strike plate 10 will preferably be easy and rapid to install using common tools, such as with screwdriver or drill, just as the prior art strike plate would be installed.

As can be seen in FIG. 2, strike plate 20 preferably has a curve 26 before hinge 40 that allows a door latch to move past hinge 40 without contacting hinge 40, and plate 27 eases the latch into a retracted position for easier closing of the door. Additionally, curve 26 minimizes the profile of hinge 40 and reduces the risk of catching items or body parts on hinge 40. Preferably, curve 26 in strike plate 20 is sized to curve slightly around the corner of the door jamb without excess space between curve 26 and the corner in order to further minimize the hinge 40 profile. While this curve 26 is preferable, alternate embodiments may remain flat or involve a more severe curve, as is desired for one's specific application or manufacturing preferences.

When latch blocker safety strike plate 10 is open, such as illustrated in FIGS. 1 and 2, preferred embodiment latch blocker 30 does not interfere with normal door latch function in association with strike plate 20. Preferably, the open latch blocker 30 rests close to the door frame such as illustrated in FIG. 2, to minimize its profile. Then, the door may be closed and locked. While closing the door, the door bolt preferably slides along the surface of curve 26 before inserting into keeper 2, just as it would with a prior art strike plate.

Figure 4:
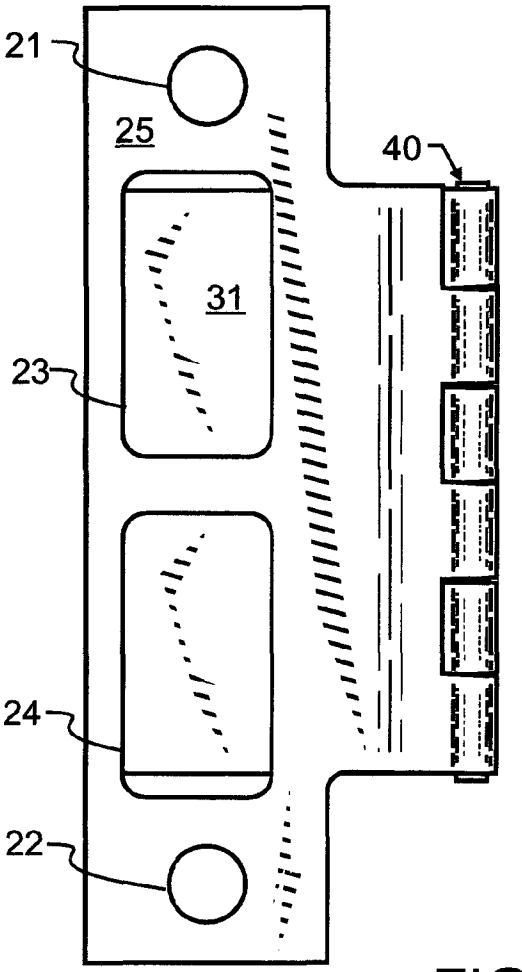
FIG. 4 illustrates the preferred embodiment latch blocker safety strike plate of FIG. 1 from a back elevational view in a closed, blocked position to further illustrate how the latch blocker covers the latch holes.
Figure 3:
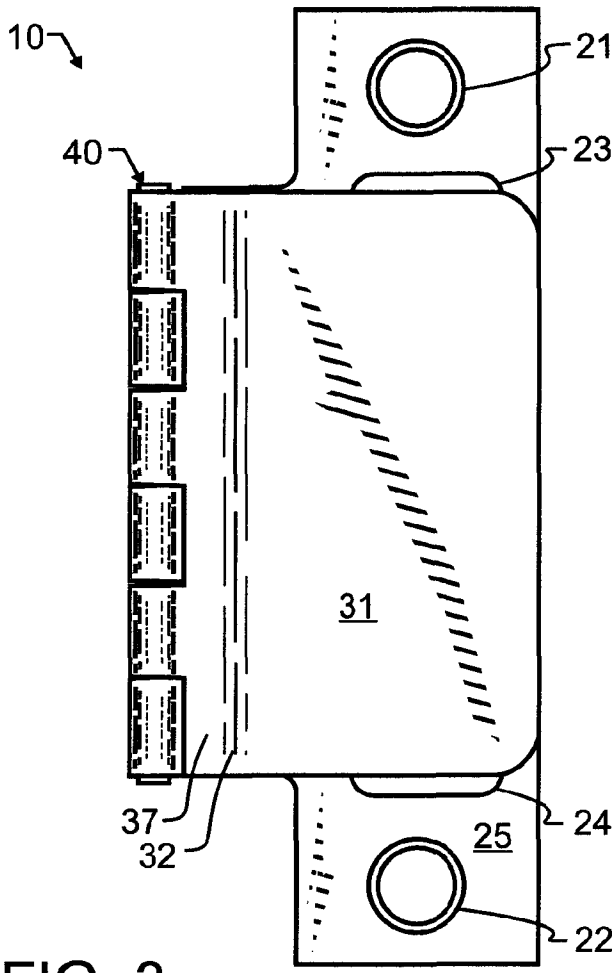
FIG. 3 illustrates the preferred embodiment latch blocker safety strike plate of FIG. 1 from a front elevational view in a closed, blocked position.

When latch blocker safety strike plate 10 is in the closed, blocked position as illustrated in FIGS. 3-5, latch blocker 30 is located between the door edge and door jamb 1 when the door is closed. In this position, latch holes 23, 24 are sufficiently covered to prevent the door bolt from inserting into keeper 2 and holding the door closed and possibly locked. This offers many benefits, including providing quiet entry and exit in a situation where sound may serve as a distraction, such as a classroom. A closed door offers privacy and sound protection, but it may be desirable for the door to be used while quietness is still preferred. The present invention allows the door to be shut but not latched, and oftentimes, it is the latching process that causes distracting noises. The door may then be opened and closed without excessive noise. Alternatively, there may be situations where an individual has physical limitations that make unlatching a door difficult, due to issues such as age or physical disability. By preventing the door from latching, an individual may just push on the door. Additionally, in situations with automatically locking doors, latch blocker 30 prevents the need for an individual to always have the appropriate keys. This may be an important safety feature for rooms that do not allow egress without a key, or in emergency situations such as a lock down when it may take excess time to procure the appropriate keys to lock a door, such as in rooms with multiple doors but only one key, or when the person with the necessary keys are not immediately positioned by the door. In such a situation, the closest or quickest person will partially open the door, pivot latch blocker 30 about hinge pin 42 from the position of FIG. 5 to the position of FIG. 2, and then shut the door. If the handle was pre-locked in preparation for such a circumstance, the door would then very quickly and efficiently be locked by anyone in close proximity, without any need for a key.

As can be seen in FIG. 1, the preferred hinge 40 is formed by lining up alternating holes from looped portions 28 of strike plate 20 and looped portions 33 of latch blocker 30 and inserting a pin 42, in the manner of most door hinges. This is not intended to limit the scope of the invention, and hinge 40 may be of any construction that allows the latch blocker 30 to rotate from a position that is concurrent to the strike plate 20 to a position that is out of the way of the door bolt, preferably approximately 270 degrees so that it may lie flat against the door frame. Nevertheless, it is desirable that preferred embodiment latch blocker safety strike plate 10 be essentially maintenance-free, durable and dependable, preferably capable of being exposed to the elements for use with either exterior or interior doors and further having ensured presence, so that the apparatus cannot be lost or misplaced. The use of hinge 40 or an equivalent ensures this presence and availability, while offering the other desired benefits and features. In addition, a simple hinge such as hinge 40 illustrated herein requires a consistent activation force, independent of ordinary manufacturing or installation events, which is also highly desired. This is in stark contrast to the Mossotti et al patent incorporated herein above by reference, which is instead highly sensitive to the extent of fastener installation force used.

As can be seen in FIG. 5, latch blocker 30 preferably fits tightly against strike plate 20 when closed and blocking the latch, and will have a like surface profile that engages with the door bolt. This reduces unnecessary resistance or interference when shutting the door. It is also desirable for latch blocker 30 to still remaining durable. The strike plate 20 and latch blocker 30 may, if desired, be made of different materials, as desired for manufacturing or different intended applications. The material used will preferably not abrade or become damaged during door bolt contact and motion, and most ideally will allow for minimal friction when the door bolt is sliding along it. The intended environmental conditions should also be taken into consideration when selecting a suitable material. Exterior doors will preferably incorporate materials that will survive temperature extremes and moisture contact, such as brass or stainless steel, while interior doors may be fabricated from a wider array of materials. In the preferred embodiment, a metal such as stainless steel is most desirable, providing a good combination of environmental resistance and durability.

Additionally, where desired various coatings or laminates of different materials may optionally be provided, such as a slippery plastic coating to facilitate the door sliding quietly, or an anti-corrosion coating or plating such as zinc to protect a lower cost base metal such as steel from corrosion.

Several embodiments of latch blocker safety strike plates designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, or where parts are not expressly numbered, except where such substitution would otherwise destroy operation of the embodiment. Consequently, those skilled in the art will readily determine the function and operation of many of the components illustrated herein without unnecessary additional description.

Figure 6:
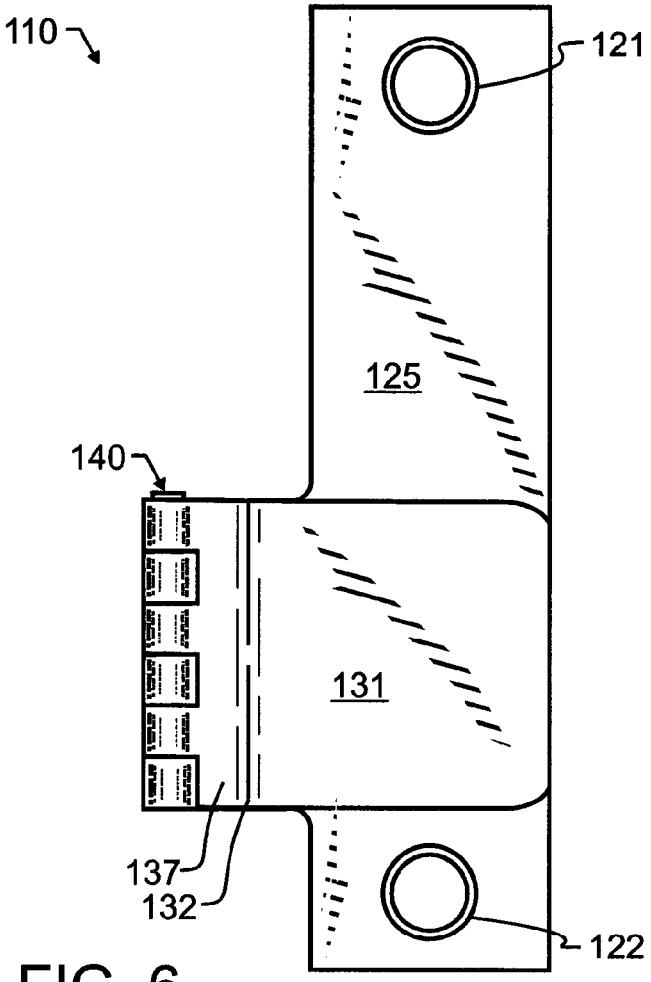
FIG. 6 illustrates a first alternative embodiment latch blocker safety strike plate designed in accord with the teachings of the present invention from a front elevational view in a closed, blocked position.

In the preferred embodiment, latch blocker 30 does not fully cover latch holes 23, 24. Alternative embodiments may vary in the amount that latch holes 23, 24 are covered, such as by covering the latch holes in excess or providing just a narrow blocking strip. FIG. 6 illustrates an alternative embodiment latch blocker safety strike plate 110, wherein a latch blocker 130 is proportionally much smaller than latch blocker 30, and wherein there is only one hole 124 for a bolt to pass through.

The preferred embodiment latch blocker safety strike plate 10 and alternative embodiments are well suited for public buildings such as schools and other institutions, offices and the like. However, the present invention is not solely limited thereto, and will find application with any portal or closure that heretofore utilizes a strike plate, or which could reasonably be retrofitted to do so. Consequently, in any situation where it is desirable to quickly switch from an open and keyless access to a locked and secured configuration, the present invention may be applied. Latch blocker safety strike plates designed in accord with the teachings of the present invention will preferably provide an apparatus that can be used repeatedly, without harm to the door or the door frame, and which will allow the door to completely close when in use, and thereby allow the door to also act as a barrier to movement of air, which can be critical in heating, ventilation and air conditioning (HVAC); in limiting noise transmission; and in limiting the spread of a fire, gas leak, noxious gases, hazardous chemical release, or other similar emergency.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a door having a latching door lock, and a door jamb having a strike plate and keeper operative with said latching door lock to lock said door, said strike plate comprising:

a generally planar surface with at least one keeper hole therein through which said latching door lock is configured to engage and to thereby lock said door;

a surface extension curved out of a plane defined by said generally planar surface and extending from an edge of said generally planar surface distal to said at least one keeper hole and adjacent to an edge of the door jamb, a hinge adjacent to and affixed with said surface extension distal to said generally planar surface;

a latch blocker having a generally planar latch blocker plate and a latch blocker extension curved out from a plane defined by said latch blocker plate and extending from an edge of said latch blocker plate;

said latch blocker pivotally coupled through said hinge and pivotal thereabout to a first end position of travel having said latch blocker plate immediately adjacent to said generally planar surface and thereby covering said generally planar surface and said at least one keeper hole and having said latch blocker extension immediately adjacent to said surface extension, said latch blocker extension configured to contact said latching door lock prior to said latching door lock contacting said latch blocker plate during closing and configured to progressively compress said latching door lock as said door is progressively closed;

said latch blocker pivotal about said hinge to a second position of travel distal to said first end position of travel and in said second position of travel uncovering said generally planar surface and said at least one keeper hole and thereby adapted to operatively enable said latching door lock to engage said at least one keeper hole;

said surface extension configured to contact said latching door lock prior to said latching door lock contacting said generally planar surface during closing and configured to progressively compress said latching door lock as said door is progressively closed.

2. The combination door having a latching door lock and door jamb having a strike plate and keeper of claim 1, wherein said hinge further defines a generally vertical axis of rotation of said latch blocker relative to said generally planar surface.

3. The combination door having a latching door lock and door jamb having a strike plate and keeper of claim 1, wherein said second position of travel is rotated approximately 270 degrees from said first end position of travel.

4. The combination door having a latching door lock and door jamb having a strike plate and keeper of claim 1, wherein said latch blocker plate is adjacent to said generally planar surface and generally perpendicular to said door when at said first end position of travel.

5. The combination door having a latching door lock and door jamb having a strike plate and keeper of claim 1, wherein said latch blocker plate is adjacent to said door jamb and generally parallel to said door when at said second position of travel.

6. The combination door having a latching door lock and door jamb having a strike plate and keeper of claim 1, wherein said generally planar surface further comprises spaced apart mounting holes adapted to operatively align with strike plate mounting holes in said door jamb, with said at least one keeper hole interposed between said generally planar surface mounting holes.

7. The combination door having a latching door lock and door jamb having a strike plate and keeper of claim 1, wherein said at least one keeper hole further comprises two keeper holes in generally vertical alignment, wherein said strike plate is reversible top to bottom for installation.

8. A latch blocker safety strike plate, comprising:

a strike plate having a generally planar surface and a curved section extending from a border of and out of a plane defined by said generally planar surface, said strike plate generally planar surface having a keeper hole there through adapted to operatively align with a keeper opening in a door jamb;

a latch blocker having a generally planar plate and a curved section extending from a border of and out of a plane defined by said latch blocker plate; and a hinge pivotally coupling said latch blocker to said strike plate;

said latch blocker plate pivotal about said hinge to a first farthest position of rotation in a first direction about said hinge and in said first farthest position of rotation lying parallel and immediately adjacent to said strike plate generally planar surface and configured to thereby block said keeper hole, said latch blocker curved section configured to contact a door bolt prior to said door bolt contacting said latch blocker plate during door closing when said latch blocker plate is in said first farthest position of rotation and to progressively compress said door bolt as said door is progressively closed, and to a second position of rotation in a second direction about said hinge opposed to said first direction of rotation to displace said latch blocker plate from said strike plate generally planar surface and thereby expose said keeper hole, said strike plate curved section configured to contact said door bolt prior to said door bolt contacting said strike plate generally planar plate during door closing when said latch blocker plate is in said second position of rotation and to progressively compress said door bolt as said door is progressively closed.

9. The latch blocker safety strike plate of claim 8, wherein said hinge further defines a generally vertical axis of rotation of said latch blocker relative to said strike plate.

10. The latch blocker safety strike plate of claim 8, wherein said second position of rotation is rotated approximately 270 degrees from said first end position of rotation.

11. The latch blocker safety strike plate of claim 8, wherein said latch blocker plate is generally perpendicular to said strike plate generally planar surface when at said second position of rotation.

12. The latch blocker safety strike plate of claim 8, wherein said strike plate further comprises spaced apart mounting holes with said keeper hole interposed between said mounting holes.

13. The latch blocker safety strike plate of claim 8, wherein said keeper hole further comprises two keeper holes in generally vertical alignment, wherein said latch blocker safety strike plate is reversible top to bottom for installation.

14. A latch blocker safety strike plate, comprising:

a strike plate having a generally planar plate and a curved section extending from said generally planar plate, said generally planar plate having spaced apart mounting holes and having a keeper hole there through configured to operatively align with a keeper opening in a door jamb when lying in a plane parallel to a first face of said door jamb, said keeper hole interposed between said mounting holes, said curved section configured to wrap about said door jamb from said first face of said door jamb toward a second perpendicular face when said generally parallel plate is lying in said plane parallel to said first face of said door jamb;

a latch blocker having a generally planar plate and a curved section extending from said latch blocker plate and configured to wrap about said door jamb from said first face of said door jamb toward said second perpendicular face when said latch blocker plate is lying in said plane parallel to said first face of said door jamb; and a hinge pivotally coupling said latch blocker to said strike plate and defining a generally vertical axis of rotation of said latch blocker relative to said strike plate;

said latch blocker plate pivotal about said hinge to a first farthest position of rotation in a first direction about said hinge lying parallel and immediately adjacent to said strike plate generally planar plate and thereby block said keeper hole, said latch blocker curved section lying adjacent to and covering said strike plate curved section in said first farthest position of rotation, and to a second position of rotation rotated approximately 270 degrees from said first end position of rotation in a second direction about said hinge opposed to said first direction of rotation to displace said latch blocker plate from said strike plate generally planar plate and thereby expose said keeper hole, said latch blocker generally planar plate generally perpendicular to said strike plate when at said second position of rotation.

15. The latch blocker safety strike plate of claim 14, wherein said at least one keeper hole further comprises two keeper holes in generally vertical alignment, wherein said strike plate is reversible top to bottom for installation.

16. The latch blocker safety strike plate of claim 14, wherein said latch blocker curved section and said strike plate curved section having like curvature and nest together in said first farthest position of rotation.

17. The latch blocker safety strike plate of claim 14, wherein said hinge is coupled to said latch blocker curved section distal to said latch blocker plate and is coupled to said curved section distal to said generally planar plate.

18. The latch blocker safety strike plate of claim 1, wherein said hinge is coupled to said latch blocker curved section distal to said latch blocker plate.

19. The latch blocker safety strike plate of claim 18, wherein said hinge is removed from contact with said latching door lock during closing.

20. The latch blocker safety strike plate of claim 8, wherein said hinge is coupled to said latch blocker curved section distal to said latch blocker plate and is coupled to said strike plate curved section distal to said strike plate generally planar surface.

* * * * *